US011654458B2

(12) United States Patent
Lee et al.

(10) Patent No.: US 11,654,458 B2
(45) Date of Patent: May 23, 2023

(54) SUBSTRATE-CLEANING APPARATUS HAVING TILTABLE ROLL BRUSH

(71) Applicant: SAMSUNG ELECTRONICS CO., LTD., Suwon-si (KR)

(72) Inventors: Yonghee Lee, Seoul (KR); Byoungho Kwon, Hwaseong-si (KR); Kuntack Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 394 days.

(21) Appl. No.: 17/081,855

(22) Filed: Oct. 27, 2020

(65) Prior Publication Data

US 2021/0362198 A1 Nov. 25, 2021

(30) Foreign Application Priority Data

May 21, 2020 (KR) ..... 10-2020-0060842

(51) Int. Cl.
*B08B 1/00* (2006.01)
*B08B 13/00* (2006.01)
(Continued)

(52) U.S. Cl.
CPC ..... *B08B 1/002* (2013.01); *A46B 13/001* (2013.01); *A46B 13/02* (2013.01); *B08B 1/04* (2013.01); *B08B 3/04* (2013.01); *B08B 13/00* (2013.01); *A46B 2200/30* (2013.01); *B24B 7/00* (2013.01); *B24B 7/22* (2013.01); *B24B 37/00* (2013.01); *B24B 37/04* (2013.01)

(58) Field of Classification Search
CPC ..... H01L 22/20; H01L 22/12; H01L 22/00; H01L 21/54; H01L 29/84; H01L 21/67253; B24B 7/228; B24B 37/04; B24B 37/08; B24B 37/005; B24B 27/0023; B24B 29/00; B24B 37/10; A46B 15/0012; B08B 11/02; G05D 3/20
See application file for complete search history.

(56) References Cited

U.S. PATENT DOCUMENTS 6,237,176 B1 5/2001 Egoshi et al.
8,496,758 B2 7/2013 Idani
(Continued)

FOREIGN PATENT DOCUMENTS

KR 20150039681 A 4/2015
KR 101519817 B1 5/2015
(Continued)

*Primary Examiner* — Katina N. Henson
(74) *Attorney, Agent, or Firm* — Volentine, Whitt & Francos, PLLC

(57) ABSTRACT

A substrate-cleaning apparatus may include a tilting arm to which a roll brush and a motor are coupled, a support arm positioned on the tilting arm, a first spring and a second spring coupling the tilting arm to the support arm, a first air bag and a second air bag mounted between the tilting arm and the support arm, and a controller configured to adjust an internal pressure of each of the first air bag and the second air bag. The controller may adjust a difference in internal pressure between the first air bag and the second air bag to control the inclination of the roll brush, and may adjust the internal pressure of each of the first air bag and the second air bag to move the roll brush vertically.

20 Claims, 9 Drawing Sheets

(51) Int. Cl.

| | |
|---|---|
| ***B08B 1/04*** | (2006.01) |
| ***A46B 13/00*** | (2006.01) |
| ***A46B 13/02*** | (2006.01) |
| ***B08B 3/04*** | (2006.01) |
| *B24B 7/22* | (2006.01) |
| *B24B 37/04* | (2012.01) |
| *B24B 37/00* | (2012.01) |
| *B24B 7/00* | (2006.01) |

(56) References Cited

U.S. PATENT DOCUMENTS

| | | | | |
|---|---|---|---|---|
| 9,579,695 | B2 | 2/2017 | Mori et al. | |
| 9,978,617 | B2 * | 5/2018 | Tanaka | H01L 21/67046 |
| 10,361,101 | B2 | 7/2019 | Kitagawa et al. | |
| 10,575,697 | B2 | 3/2020 | Imamura et al. | |
| 2015/0099433 | A1 | 4/2015 | Tanaka | |
| 2018/0289230 | A1 * | 10/2018 | Imamura | H01L 21/67253 |

FOREIGN PATENT DOCUMENTS

| | | | |
|---|---|---|---|
| KR | 20190011109 | A | 2/2019 |
| KR | 102063464 | B1 | 1/2020 |

* cited by examiner

10b

SUBSTRATE-CLEANING APPARATUS HAVING TILTABLE ROLL BRUSH

CROSS-REFERENCE TO THE RELATED APPLICATION

This application claims priority from Korean Patent Application No. 10-2020-0060842 filed on May 21, 2020 in the Korean Intellectual Property Office, the subject matter of which is hereby incorporated by reference in its entirety.

BACKGROUND

1. Field

The inventive concept relates generally to substrate-cleaning apparatuses including a tiltable roll brush.

2. Description of the Related Art

Chemical mechanical polishing (CMP) may be performed on a wafer (or substrate) in order to shape the wafer or form a desired pattern on the wafer. Once CMP is completed, a cleaning process may be applied to the wafer in order to remove various contaminants (e.g., particles, residues, organic pollutants, etc.) remaining on a surface of the wafer as the result of the CMP.

Conventionally, the cleaning process has been performed by inserting the substrate between vertically arranged roll brushes. Once the wafer is properly seated (e.g., using a substrate support), and the roll brushes may rotate while moving up and down against the substrate to clean surface(s) of the substrate. While the roll brushes are rotating, the substrate may also be rotated by rollers mounted to the substrate support. However, because the roll brushes have fixed outer diameters, when the roll brushes and the substrate rotate at the same time, the frequency of contact between the substrate and the roll brushes gradually decreases towards the outer edge of the substrate. This outcome results in inefficient cleaning of the substrate edge as compared with the cleaning efficiency of the center of the substrate.

SUMMARY

Embodiments of the inventive concept provide a substrate-cleaning apparatus including a tiltable roll brush capable of efficiently cleaning the entirety of a substrate (e.g., both edge and center portions of a substrate).

A substrate-cleaning apparatus according to embodiments of the inventive concept may include; a roll brush coupled to a tilting arm, a support arm positioned on the tilting arm, a first spring and a second spring coupling the tilting arm to the support arm, a first air bag and a second air bag mounted between the tilting arm and the support arm, and a controller configured to adjust a first internal pressure of the first air bag and a second internal pressure of the second air bag, wherein the controller defines an inclination of the roll brush by adjusting a difference between the first internal pressure and the second internal pressure.

A substrate-cleaning apparatus according to embodiments of the inventive concept may include; roll brush coupled to a tilting arm, wherein the tilting arm includes a motor-coupling portion securing a motor, a support arm positioned on the tilting arm, a first air bag and a second air bag mounted between the tilting arm and the support arm, an upper bracket positioned between the first air bag and the second air bag and protruding from a bottom surface of the support arm, a lower bracket protruding from a top surface of the tilting arm, a pivot shaft inserted into the upper bracket and the lower bracket, and a controller configured to adjust a first internal pressure of the first air bag and a second internal pressure of the second air bag, wherein the controller defines an inclination of the roll brush by adjusting a difference between the first internal pressure and the second internal pressure.

A substrate-cleaning apparatus according to embodiments of the inventive concept may include; a roll brush, a motor configured to rotate the roll brush, a tilting arm including a bracket to support the roll brush and a motor-coupling portion to secure the motor, a driving shaft of the motor penetrating the motor-coupling portion to be connected to the roll brush, a support arm positioned on the tilting arm, a first air bag and a second air bag suspending the tilting arm from the support arm, a vertical shaft securing the support arm, an vertical adjustment driving unit coupled to the vertical shaft to vertically adjust the tilting arm and the support arm, a regulator connected to the first air bag and the second air bag, and a controller configured to control the regulator to adjust a first internal pressure of the first air bag and a second internal pressure of the second air bag, wherein the controller adjusts a difference between the first internal pressure and the second internal pressure to control an inclination of the tilting arm.

DETAILED DESCRIPTION

Throughout the written description and drawings, like reference numbers and labels are used to denote like or similar elements and/or features. Throughout the written description certain geometric terms may be used to highlight relative relationships between elements, components and/or features with respect to certain embodiments of the inventive concept. Those skilled in the art will recognize that such geometric terms are relative in nature, arbitrary in descriptive relationship(s) and/or directed to aspect(s) of the illustrated embodiments. Geometric terms may include, for example: height/width; vertical/horizontal; top/bottom; higher/lower; closer/farther; thicker/thinner; proximate/distant; above/below; under/over; upper/lower; center/side; surrounding; between; overlay/underlay; etc.

Figure 1:
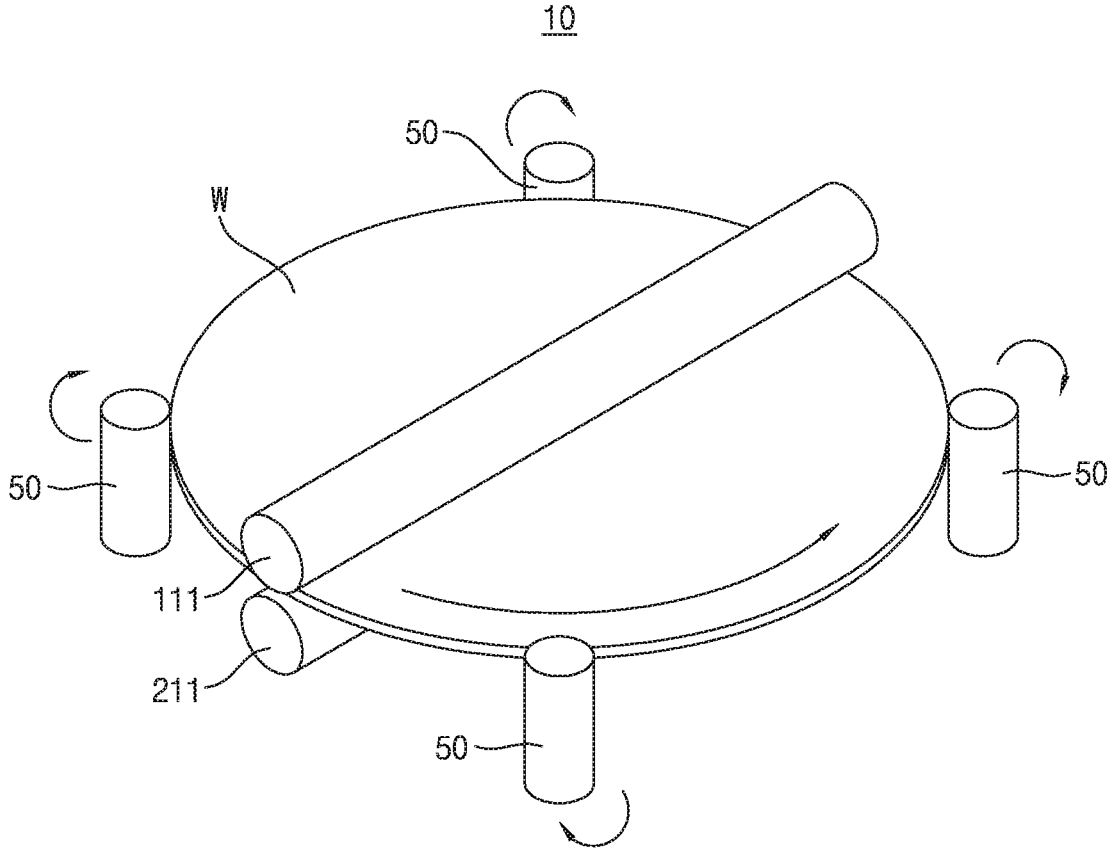
FIG. 1 is a perspective view illustrating a substrate-cleaning apparatus according to embodiments of the inventive concept.

FIG. 1 is a perspective view illustrating a substrate-cleaning apparatus according to embodiments of the inventive concept.

Referring to FIG. 1, the substrate-cleaning apparatus 10 may include support rollers 50 configured to support a substrate W and a pair of vertically-arranged roll brushes 111 and 211. The substrate W may be transferred to a space between the roll brushes 111 and 211 by a substrate transfer unit. In this position the substrate W may be supported by the support rollers 50, and as the support rollers 50 rotate in a desired direction, the substrate W will counterrotate rotate in an opposing direction. In conjunction with the rotation of the substrate W, the roll brushes 111 and 211 may rotate while in respective contact with top and bottom surfaces of the substrate W. As the roll brushes 111 and 211 respectively brush the top and bottom surfaces of the substrate W a cleaning solution and/or deionized water may be applied to the substrate W and/or the roll brushes 111 and 211.

Figure 2:
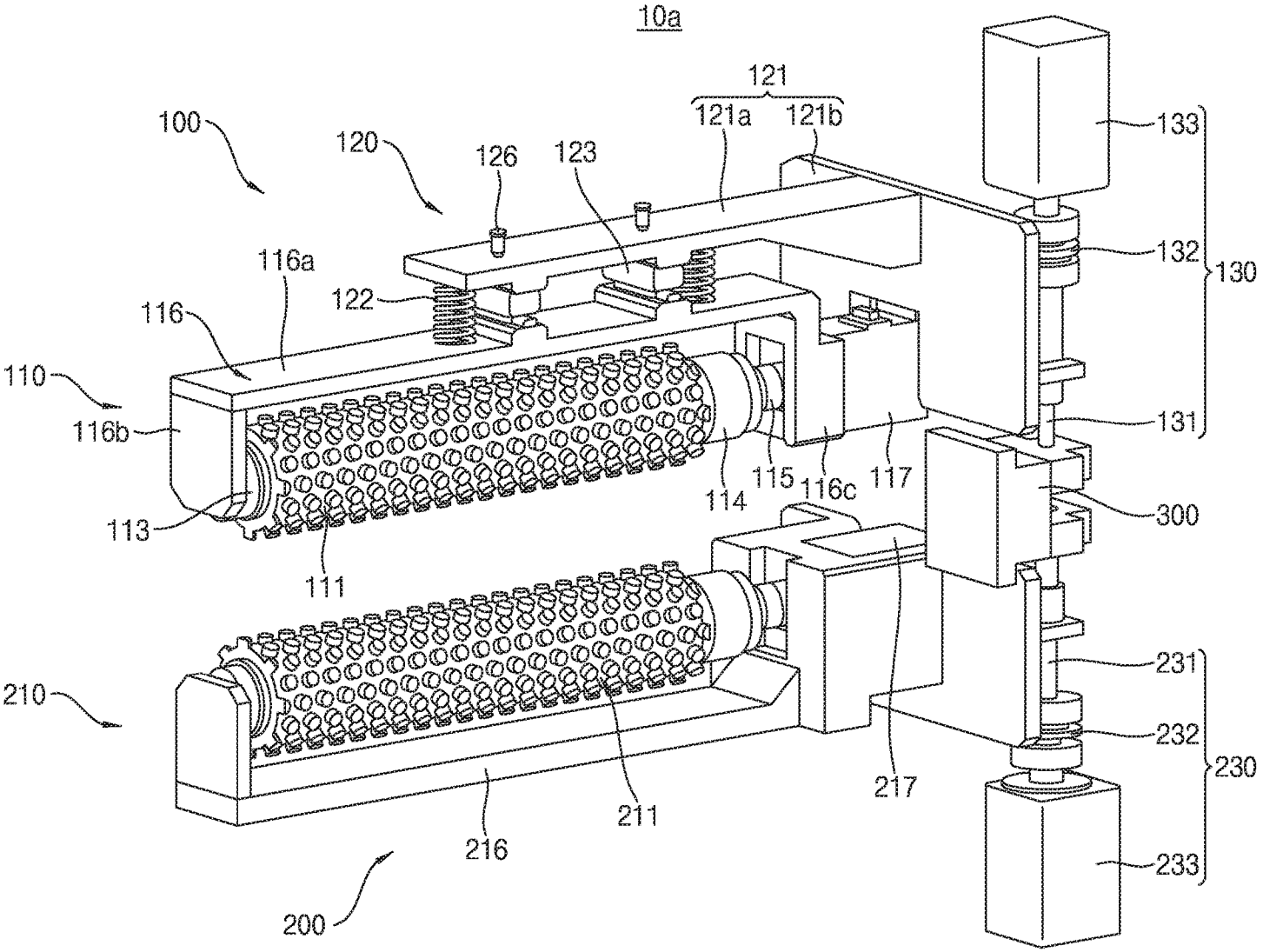
FIG. 2 is a perspective view of a substrate-cleaning apparatus according to embodiments of the inventive concept.
Figure 3:
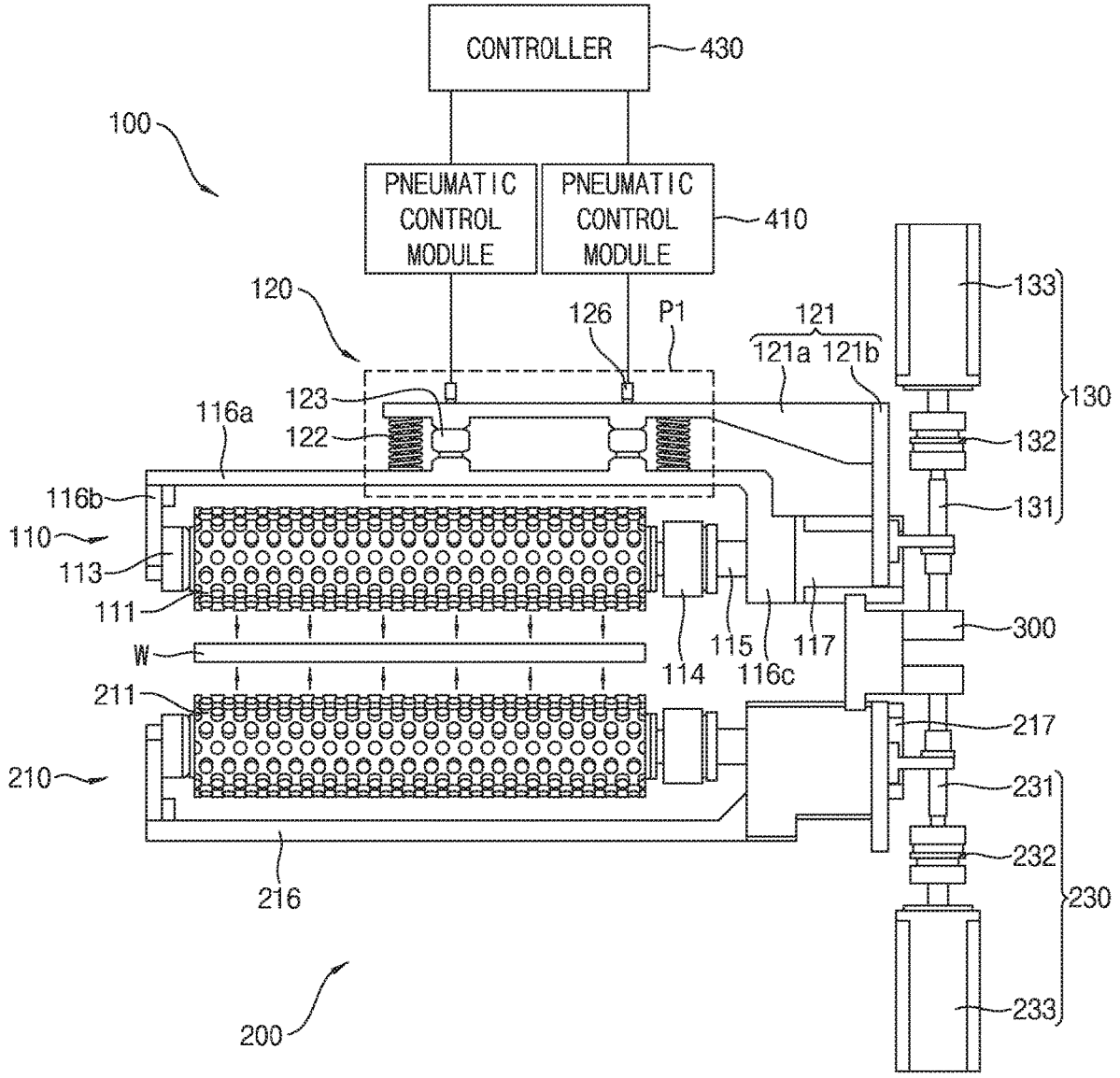
FIG. 3 is a front view of FIG. 2.

FIG. 2 is a perspective view of a substrate-cleaning apparatus according to embodiments of the inventive concept; FIG. 3 is a front view of FIG. 2; and FIG. 4 is another view of the upper cleaning unit 110 of FIG. 3.

Referring to FIGS. 2 and 3, a substrate-cleaning apparatus 10*a* may include an upper cleaning unit 100, a lower cleaning unit 200 and a connection unit 300. The upper cleaning unit 100 and the lower cleaning unit 200 may be vertically aligned and mechanically coupled to the connection unit 300. The upper cleaning unit 100 and the lower cleaning unit 200 may be used to clean the top and/or bottom surface(s) of a substrate inserted therebetween.

Figure 4:
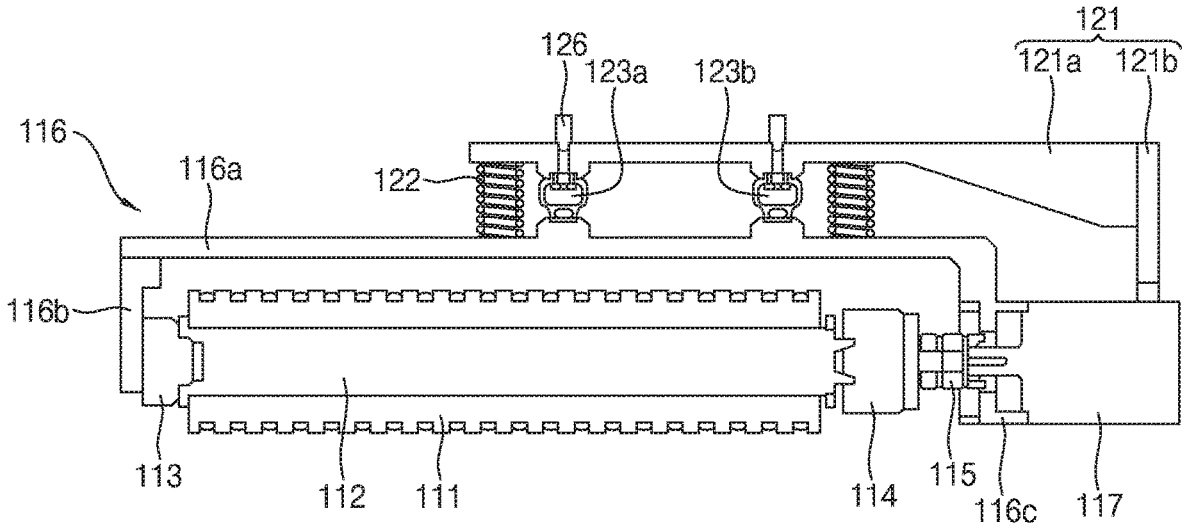
FIG. 4 is a another view of the upper cleaning unit 110 of FIG. 3.

Referring to FIGS. 2, 3 and 4, the upper cleaning unit 100 may include a brush-tilting unit 110, an air unit 120 and an upper vertical adjustment unit 130. The brush-tilting unit 110 may be located under the air unit 120, and may be suspended from the air unit 120. The upper vertical adjustment unit 130 may be laterally disposed in relation to the brush-tilting unit 110 and the air unit 120. The air unit 120 may be securely coupled to the upper vertical adjustment unit 130. In this manner, the brush-tilting unit 110 may be connected to the upper vertical adjustment unit 130 via the air unit 120. That is, the upper vertical adjustment unit 130 may be used to adjust (or move) the vertically position of the air unit 120. As the air unit 120 is vertically moved, the brush-tilting unit 110 follows. Hence, a distance (or gap) between the brush-tilting unit 110 and the lower cleaning unit 200 may be adjusted through movement of the brush-tilting unit 110 using the air unit 120.

In the illustrated example of FIG. 2, the brush-tilting unit 110 includes a roll brush 111, a shaft 112, a tilting arm 116 and a motor 117. The brush-tilting unit 110 may further include a front-end engagement part 113, a rear-end engagement part 114, and a coupling part 115.

The roll brush 111 may surround the shaft 112. A number of protrusions may be formed on the surface of the roll brush 111 in a regular arrangement. The roll brush 111 may be formed of a porous, sponge (or resin) material capable of holding and distributing liquid(s).

The shaft 112 may penetrate the roll brush 111 and be rotatably coupled to the tilting arm 116. For example, the roll brush 111 may be coupled to the tilting arm 116 via the front-end engagement part 113. The front-end engagement part 113 may be rotatably coupled to the tilting arm 116. The shaft 112 may be connected to the driving shaft of the motor 117. For example, the shaft 112 may be coupled to the driving shaft of the motor 117 via the rear-end engagement part 114 and the coupling part 115. When the driving shaft of the motor 117 rotates, the coupling part 115 and the rear-end engagement part 114 may transfer the rotational force to the shaft 112, thereby rotating the shaft 112 and the roll brush 111. The roll brush 111 may be brought into contact with the surface of the substrate while rotating, thereby applying pressure to remove contaminants (e.g., particles) from the surface of the substrate.

The tilting arm 116 may include a body portion 116*a*, a bracket 116*b* and a motor-coupling portion 116*c*. The body portion 116*a* may be disposed above the roll brush 111, and may have a bar shape that extends laterally (e.g., in a longitudinal direction) from the roll brush 111. The body portion 116*a* may be mechanically coupled to the air unit 120, and may be suspended from the air unit 120. The bracket 116*b* may be connected to one end of the body portion 116*a*, and may rotatably support the shaft 112 and the roll brush 111 via the front-end engagement part 113. The motor-coupling portion 116*c* may be bent from the opposite end of the body portion 116*a* to extend downwards. The motor 117 may be coupled to and secured to the outer side of the motor-coupling portion 116*c*. Referring to FIG. 4, the driving shaft of the motor 117 may penetrate the motor-coupling portion 116*c*, and may be connected to the shaft 112 and to the roll brush 111 via the coupling part 115 and the rear-end engagement part 114.

Referring again to FIGS. 2, 3 and 4, the motor 117 may be supported by the motor-coupling portion 116*c*, and may be spaced apart from the air unit 120 or the upper vertical adjustment unit 130. Accordingly, when the tilting arm 116 is tilted, the entirety of the motor 117 may be tilted together with the tilting arm 116, thereby avoiding the application of an eccentric load to the driving shaft of the motor 117 during the tilting operation. As noted above, the routine application of an eccentric lad to the driving shaft of the motor 117 tends to shorten the lifespan of the motor. In this regard, the "tilting" of the tilting arm 116 may be understood as a relative elevation (e.g., higher or lower) of one end (e.g., a distal end) of the tilting arm 116 to another end (e.g., a proximate end) of the tilting arm 116 relative to the connection unit 300.

The air unit 120 may include a support arm 121, a spring 122 and an air bag 123. The air unit 120 may further include a nozzle 126. The support arm 121 may be located above the tilting arm 116. The support arm 121 is directly secured to the upper vertical adjustment unit 130, and may be moved by the upper vertical adjustment unit 130. The support arm 121 may include a body 121*a* and a plate 121*b*. The body 121*a* may have a bar shape, and the plate 121*b* may be a flat panel. The body 121*a* may be coupled to an upper portion of one surface of the plate 121*b*. An engagement portion may be formed on a lower portion of the opposite surface of the plate 121*b*. The engagement portion may be secured to an upper vertical shaft 131, whereby the support arm 121 may be coupled to the upper vertical shaft 131.

The spring 122 may be mounted between the support arm 121 and the body portion 116*a* of the tilting arm 116, and may elastically connect the tilting arm 116 to the support arm 121. The upper end of the spring 122 may be secured to the bottom surface of the support arm 121, the lower end of the spring 122 may be secured to the top surface of the body portion 116*a*, and the distance between the support arm 121 and the tilting arm 116 may be maintained at a predetermined level by the elastic force of the spring 122. The spring 122 may include a first spring 122*a* and a second spring 122*b*. The first spring 122*a* and the second spring 122*b* may be spaced horizontally apart from each other at a predetermined interval, and may support the brush-tilting unit 110 so that the brush-tilling unit 110 is oriented horizontally. The intermediate point between the first spring 122*a* and the second spring 122*b* may be a point that vertically overlaps the center of gravity of the brush-tilting unit 110.

The air bag 123 may be vertically mounted between the support arm 121 and the body portion 116*a* of the tilting arm 116, and may be laterally disposed between the first spring 122*a* and the second spring 122*b*. In some embodiments, the first spring 122*a* and the second spring 122*b* may be located between a pair of air bags 123. The upper end of the air bag 123 may be secured to the bottom surface of the support arm 121, the lower end of the air bag 123 may be secured to the top surface of the body portion 116*a*, and the tilting arm 116 may be stably suspended from the support arm 121 via the spring 122 and the air bag 123.

The air bag 123 may include a first air bag 123*a* and a second air bag 123*b*. The first air bag 123*a* and the second air bag 123*b* may be laterally spaced apart at a defined interval. The first air bag 123*a* may be located further away from one end of the roll brush 111 than the second air bag 123*b*. The intermediate point between the first air bag 123*a* and the second air bag 123*b* may be a point that vertically overlaps the center of gravity of the brush-tilting unit 110. Thus, the first spring 122*a*, the first air bag 123*a*, the second air bag 123*b* and the second spring 122*b* may be laterally disposed along the tilting arm 116 in parallel with the extension direction of the roll brush 111.

In some embodiments, the first spring 122*a* may be disposed close to the first air bag 123*a*, and the second spring 122*b* may be disposed close to the second air bag 123*b*. The distance between the first spring 122*a* and the first air bag 123*a* may be substantially the same as the distance between the second spring 122*b* and the second air bag 123*b*. The first air bag 123*a* and the second air bag 123*b* may be spaced apart from each other by a distance that is longer than the distance between the first spring 122*a* and the first air bag 123*a*. Since the spring 122 provides elastic force to the tilting arm 116 in the state of being disposed close to one side of the air bag 123, the vertical movement and/or the tilting operation of the brush-tilting unit 110 due to expansion and/or contraction of the air bag 123 may be precisely controlled. Further, since the first air bag 123*a* and the second air bag 123*b* are spaced apart, the brush-tilting unit 110 may be stably supported, and the inclination of the brush-tilting unit 110 may be finely adjusted by expansion and/or contraction of the first air bag 123*a* and/or the second air bag 123*b*.

The nozzle 126 may be mounted on the support arm 121. The nozzle 126 may be connected to a gas tank via a gas supply line, and a pneumatic control module 410 may be connected to the gas supply line. A controller 430 may be provided to adjust a first internal pressure to the first air bag 123*a* and a second internal pressure to the second air bag 123*b*. The controller 430 may be connected to a pneumatic control module 410 (or alternately, a pair of pneumatic control modules 410) and may control the pneumatic control module 410 in order to adjust the pressure of the gas supplied from the gas tank to the air bag 123 through the gas supply line and the nozzle 126.

The upper vertical adjustment unit 130 may include an upper vertical shaft 131, an upper vertical adjustment coupling part 132, and an upper vertical adjustment driving unit 133. The upper vertical adjustment coupling part 132 and the upper vertical adjustment driving unit 133 may be mechanically coupled to the upper vertical shaft 131. The upper vertical shaft 131 may be coupled to and secured to the upper portion of the connection unit 300, and may support the air unit 120 and the brush-tilting unit 110.

A rotary body, mechanically coupled to the upper vertical shaft 131, may be rotated by the upper vertical adjustment driving unit 133, and may move vertically along the upper vertical shaft 131. The air unit 120 coupled to the upper vertical shaft 131 and the brush-tilting unit 110 suspended from the air unit 120 may move vertically together according to the vertical movement of the rotary body.

The lower cleaning unit 200 may include a brush unit 210 and a lower vertical adjustment unit 230, and may not include an air unit 120, in contrast with the upper cleaning unit 100. The brush unit 210 may include components that are the same as and/or similar to those of the brush-tilting unit 110 of the upper cleaning unit 100. For example, the brush unit 210 may include a roll brush 211, a holder 216, and a motor 217. The holder 216 may be disposed below the roll brush 211, and may rotatably support the roll brush 211. The motor 217 may be secured to the outer side of the holder 216, and the driving shaft of the motor 217 may penetrate the holder 216 to be connected to the roll brush 211. The holder 216 may be directly coupled to the lower vertical adjustment unit 230, and the lower vertical adjustment unit 230 may move the roll brush 211 vertically via the holder 216.

Figure 5:
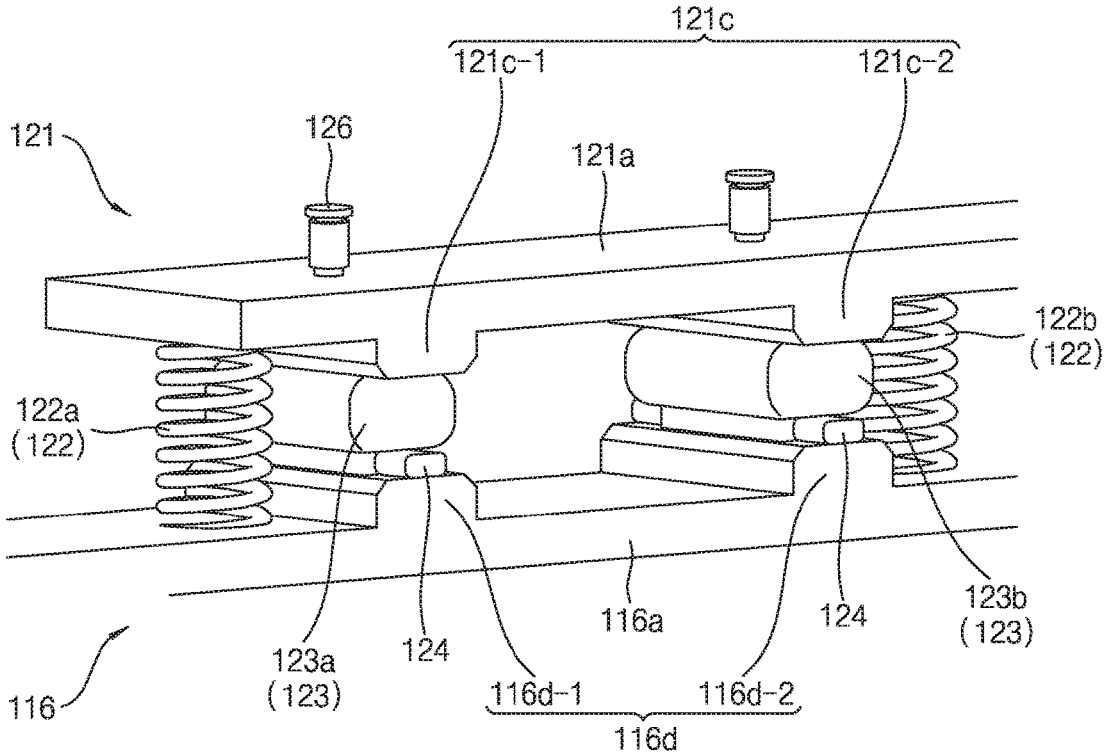
FIG. 5 is an enlarged perspective view of region P1 shown in FIG. 3.
Figure 6:
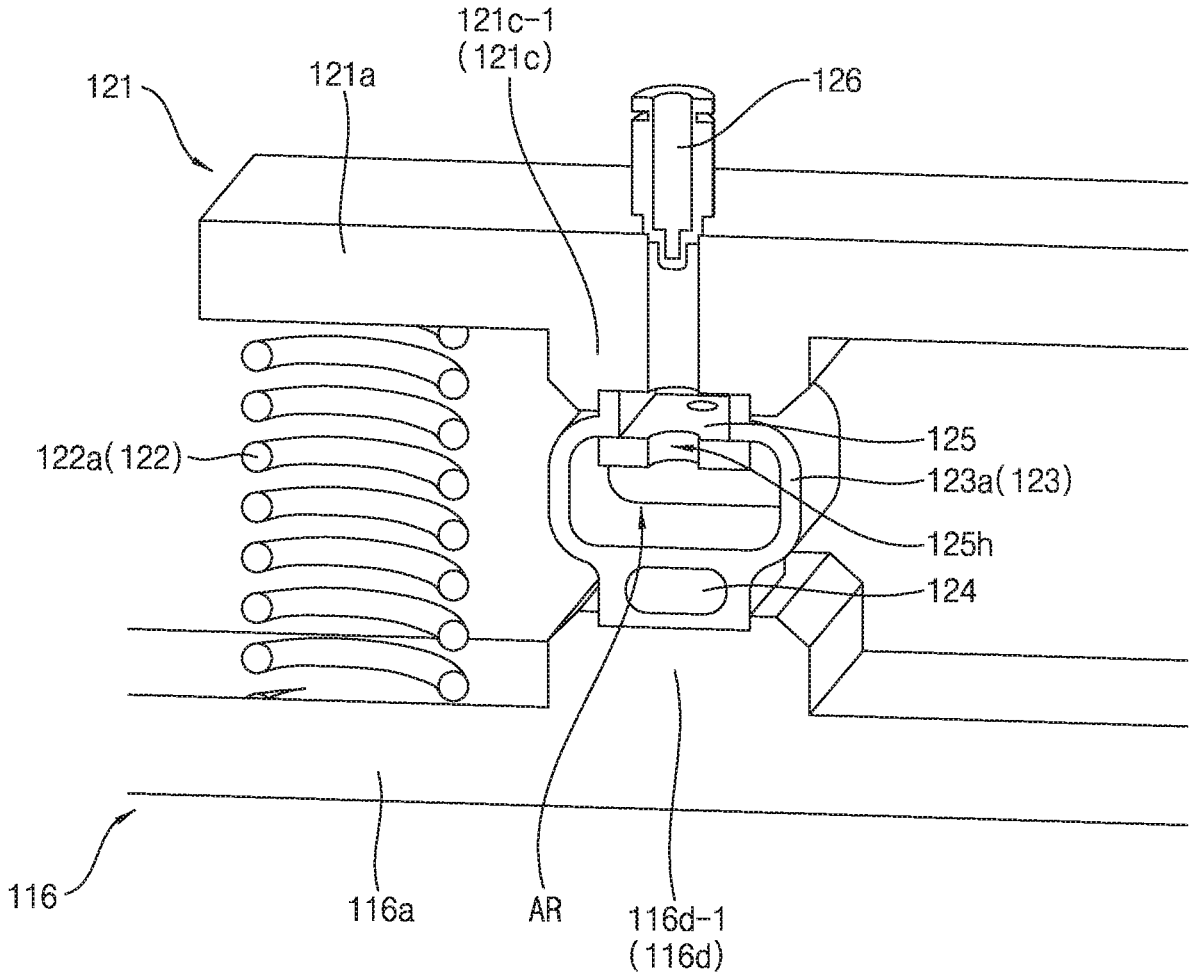
FIG. 6 is a further enlarged perspective view of FIG. 5.

FIG. 5 is an enlarged perspective view of region P1 shown in FIG. 3, and FIG. 6 is a further enlargement of certain aspects of FIG. 5.

Referring to FIGS. 5 and 6, the tilting arm 116 may further include a lower protruding portion 116*d* protruding from the top surface of the body portion 116*a*. The support arm 121 may further include an upper protruding portion 121*c* protruding from the bottom surface of the body 121*a*. The lower protruding portion 116*d* may include a first lower protruding portion 116*d*-1 and a second lower protruding portion 116*d*-2, and the upper protruding portion 121*c* may include a first upper protruding portion 121*c*-1 and a second upper protruding portion 121*c*-1. The upper protruding portion 121*c* and the lower protruding portion 116*d* may be disposed so as to vertically overlap each other. That is, the upper protruding portion 121*c* and the lower protruding portion 116*d* may be vertically aligned with each other. The air bag 123*a* or 123*b* may be interposed between the lower protruding portion 116*d* and the upper protruding portion 121*c*. The lower end of the air bag 123*a* or 123*b* may be secured to the upper end of the lower protruding portion 116*d*, and the upper end of the air bag 123*a* or 123*b* may be secured to the lower end of the upper protruding portion 121*c*. Specifically, the first air bag 123*a* may be interposed between the first lower protruding portion 116*d*-1 and the first upper protruding portion 121*c*-1, and the second air bag 123*b* may be interposed between the second lower protruding portion 116*d*-2 and the second upper protruding portion 121*c*-2.

The air unit 120 may further include a lower plate 124 penetrating the air bag 123 and an upper plate 125 positioned within an air region AR in the air bag 123. The air region AR may be a space formed in the air bag 123, in which the gas supplied for expansion and/or contraction of the air bag 123 stays. A horizontal hole may be formed below the air region AR so as to penetrate the air bag 123 horizontally. The lower plate 124 may be inserted into the horizontal hole so as to penetrate the air bag 123. One end and the opposite end of the lower plate 124 penetrating the air bag 123 may protrude from respective sides of the air bag 123, and may be securely coupled to the lower protruding portion 116*d* of the tilting arm 116. For example, the lower plate 124 may be secured to the lower protruding portion 116*d* by inserting a screw through the lower plate 124 and fastening the screw to the lower protruding portion 116*d*. Since the lower plate 124 is secured to the lower protruding portion 116*d*, the lower portion of the air bag 123 may also be secured to the lower protruding portion 116*d*.

Referring to FIG. 6, the upper plate 125 may be mounted in the air region AR. For example, the upper plate 125 may be coupled to the support arm 121, and may be suspended downwards from the upper protruding portion 121*c* of the support arm 121 using a screw. The upper portion of the air bag 123 may be interposed between the upper plate 125 and the upper protruding portion 121*c*. The upper plate 125 may support the upper portion of the air bag 123 to fix the upper end of the air bag 123 to the upper protruding portion 121*c*. A hole 125*h* may be formed in the upper plate 125, and gas may flow in and/or out (hereafter, "in/out") of the air region AR in the air bag 123 through the hole 125*h*.

The support arm 121 may include a through-hole 121*d* vertically penetrating the body 121*a* and the upper protruding portion 121*c*. The nozzle 126 may be mounted in the upper portion of the through-hole 121*d*, and the lower portion of the through-hole 121*d* may communicate with the air region AR in the air bag 123. Accordingly, the gas supplied from the gas tank through the pneumatic control module 410 may flow into or out of the air region AR in the air bag 123 through the nozzle 126 and the through-hole 121*d*.

Figure 7:
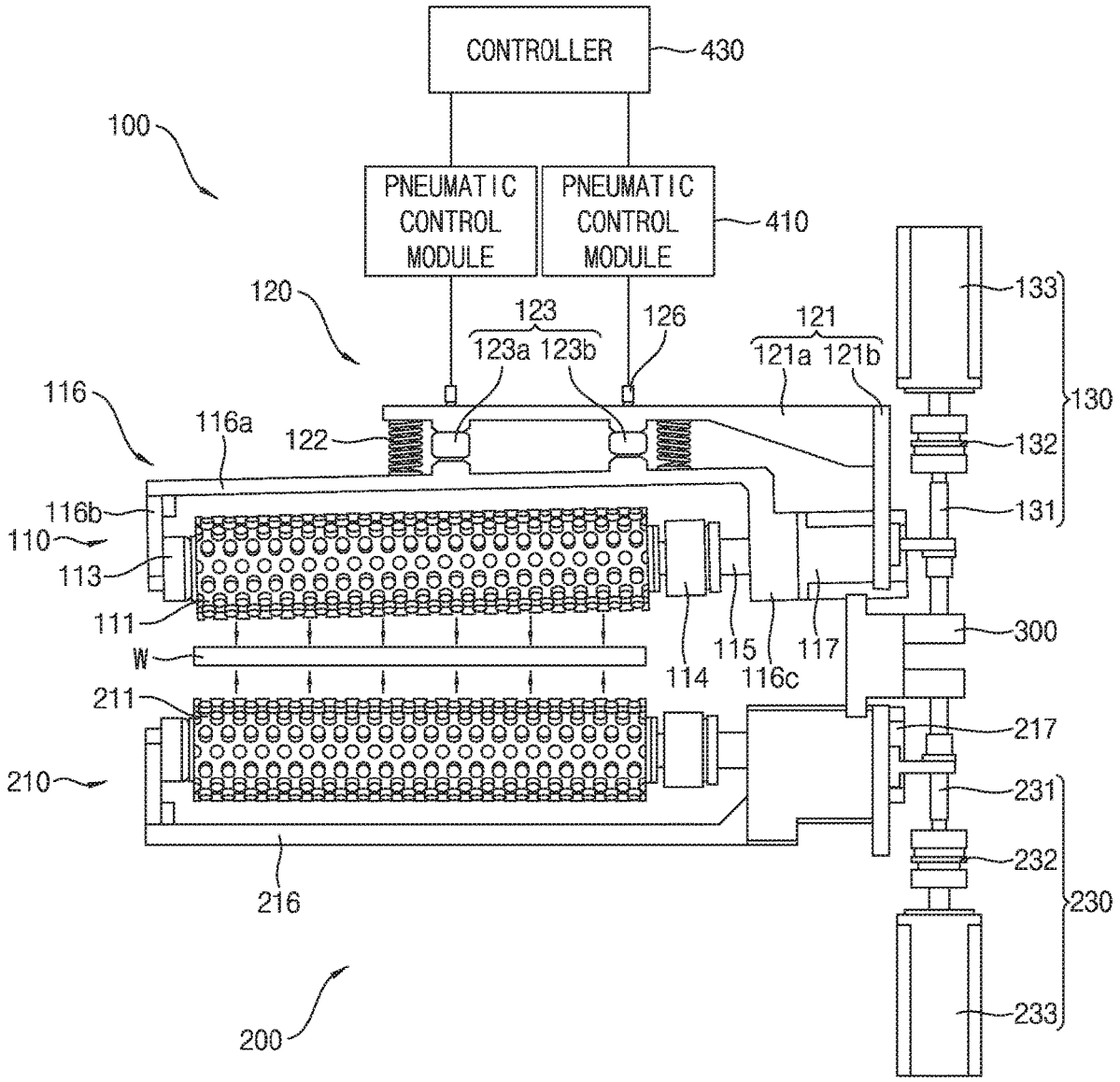
FIGS. 7 and 8 are respective views illustrating a tilting operation of the brush-tilting unit according to embodiments of the inventive concept.
Figure 8:
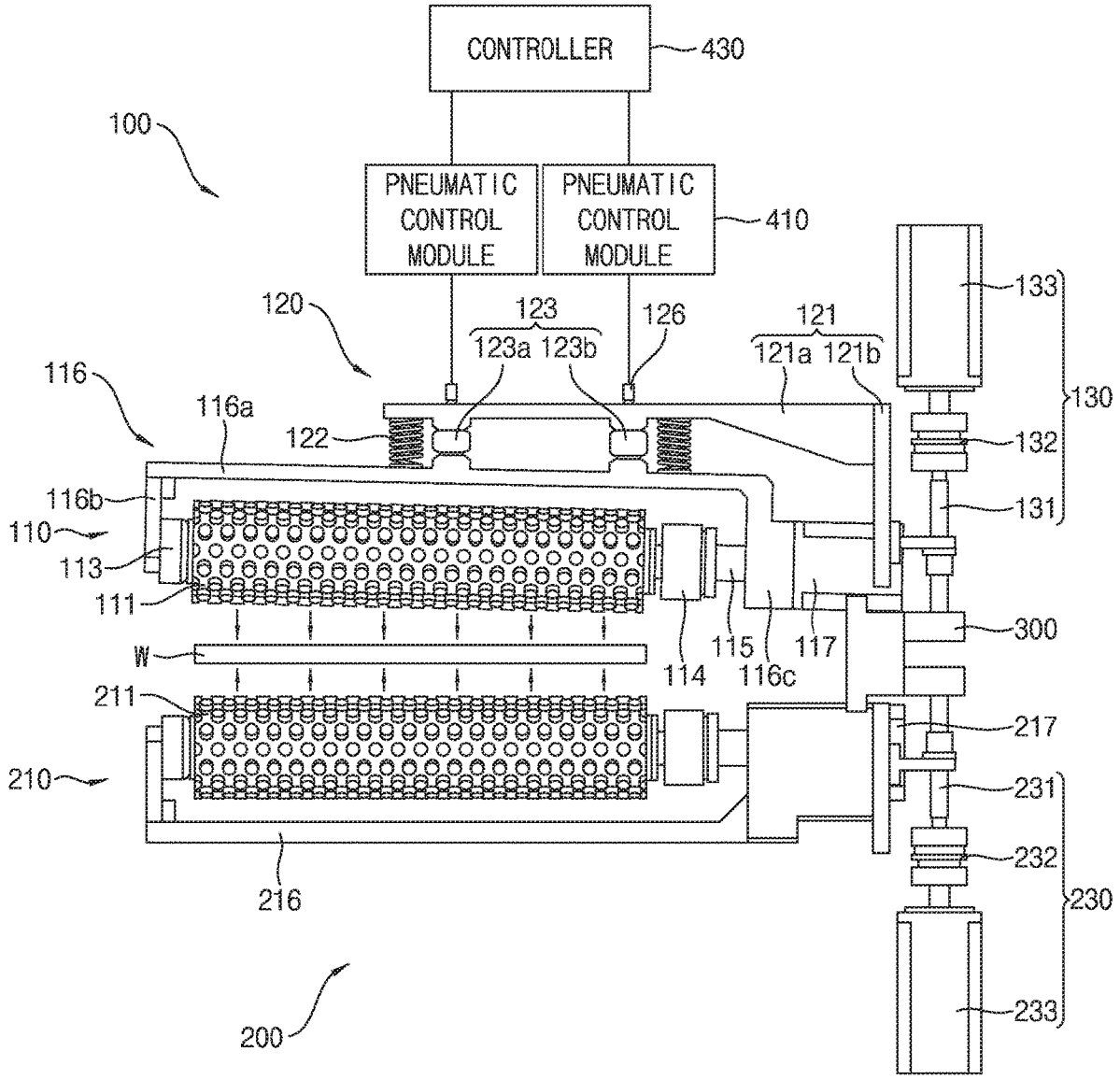

FIGS. 7 and 8 are additional views further illustrating the tilting operation of the brush-tilting unit according to embodiments of the inventive concept.

Referring to FIG. 7, the air bag 123 may include a flexible material, and may increase/decrease (or expand/contract) in volume depending on the internal pressure (i.e. the internal pressure of the air region AR illustrated in FIG. 6). For example, the air bag 123 may be made of a flexible material such as silicon or rubber. In response to the applied pressure, the air bag 123 may vertically expand/contract. That is, when the air bag 123 expands, the vertical height of the air bag 123 increases, and when the air bag 123 contracts, the vertical height of the air bag 123 decreases. The air bag 123 may also expand/contract horizontally in response to the applied pressure.

The controller 430 may be used to further define an inclination of the roll brush 111 by creating (or adjusting) a difference in internal pressure between the first air bag 123*a* and the second air bag 123*b*. The controller 430 may tilt the tilting arm 116 by creating a difference between the first internal pressure applied to the first air bag 123*a* and the second internal pressure applied to the second air bag 123*b*. In this manner, the entirety of the brush-tilting unit 110 may be tilted as the tilting arm 116 is tilted. That is, the roll brush 111 and the motor 117, which are secured to the tilting arm 116, may be tilted together with the tilting arm 116. The controller 430 may adjust the inclination of the roll brush 111 to change the contact pressure applied to the edge region of the substrate W, and may adjust the rotational stiffness of the roll brush 111 with respect to the substrate W.

In some embodiments, the controller 430 may control the pneumatic control module 410 connected to the first air bag 123*a* and/or the second air bag 123*b*, such that the first internal pressure of the first air bag 123*a* is greater than the second internal pressure of the second air bag 123*b*. Accordingly, the volume (and vertical height) of the first air bag 123*a* may become greater than that of the second air bag 123*b*, and the roll brush 111 may be tilted such that one end is higher than the other end.

The volume of the first air bag 123*a* may become greater than the second air bag 123*b* when the first air bag 123*a* expands while the second air bag 123*b* remains stable, when the second air bag 123*b* contracts while the first air bag 123*a* remain stable, when the first air bag 123*a* expands more than the second air bad 123*b*, or when the first air bag 123*a* expands while the second air bag 123*b* contracts. In one example, when the amount of gas in the first air bag 123*a* increases in response to a control signal from the controller 430, the internal pressure of the first air bag 123*a* may increase, and accordingly, the first air bag 123*a* may expand. In this case, the first spring 122*a*, which is located adjacent to the first air bag 123*a*, may extend. In another example, when the amount of gas in the second air bag 123*b* decreases in response to a control signal from the controller 430, the internal pressure of the second air bag 123*b* may decrease, and accordingly, the second air bag 123*b* may contract. In this case, the second spring 122*b*, which is located adjacent to the second air bag 123*b*, may also contract together with the second air bag 123*b*. In still another example, when the amount of gas in the first air bag 123*a* increases and the amount of gas in the second air bag 123*b* decreases in response to a control signal from the controller 430, the internal pressure of the first air bag 123*a* may increase, and the internal pressure of the second air bag 123*b* may decrease, whereby the first air bag 123*a* may expand, and the second air bag 123*b* may contract. In this case, the first spring 122*a*, which is located adjacent to the first air bag 123*a*, may extend, and the second spring 122*b*, which is located adjacent to the second air bag 123*b*, may contract.

Referring to FIGS. 5 and 7, when the volume of the first air bag 123*a* becomes greater than that of the second air bag 123*b*, the vertical height of the first air bag 123*a* may become greater than that of the second air bag 123*b*, and the vertical distance between the first upper protruding portion 121*c*-1 and the first lower protruding portion 116*d*-1 may become slightly greater than the vertical distance between the second upper protruding portion 121*c*-2 and the second lower protruding portion 116*d*-2. Accordingly, the tilting arm 116 may be tilted such that one end of the body portion 116*a*, from which the motor-coupling portion 116*c* extends, is higher than the opposite end of the body portion 116*a*, to which the bracket 116*b* is connected. Since the entirety of the brush-tilting unit 110 is tilted when the tilting arm 116 is tilted, the roll brush 111 may also be tilted such that one end thereof is higher than the opposite end thereof. For example, in the state in which the tilting arm 116 is oriented horizontally as shown in FIG. 3, when the volume of the first air bag 123*a* becomes greater than that of the second air bag 123*b*, the tilting arm 116 (i.e. the brush-tilting unit 110) may be tilted in the counterclockwise direction, as shown in FIG. 7. As the tilting arm 116 is tilted, the roll brush 111 and the motor 117, which are secured to the tilting arm 116, may also be tilted together therewith. As the roll brush 111 is tilted, the contact pressure between the surface of the roll brush 111 and the edge region of the top surface of the substrate W may increase. Accordingly, the efficiency of cleaning of the edge region of the roll brush 111 may be improved.

In some embodiments, the controller 430 may increase the internal pressure of the first air bag 123*a* and the internal pressure of the second air bag 123*b* such that the internal pressure of the first air bag 123*a* is greater than the internal pressure of the second air bag 123*b*, thereby making both the first air bag 123*a* and the second air bag 123*b* expand. In this case, since the volume of the first air bag 123*a* is greater than the volume of the second air bag 123*b*, the tilting arm 116 may be tilted in the counterclockwise direction. At the same time, since both the volume of the first air bag 123*a* and the volume of the second air bag 123*b* increase, the tilting arm 116 may move vertically downwards. Each of the first spring 122*a* and the second spring 122*b* may be extended. In this case, as the roll brush 111 is tilted, the contact pressure between the surface of the roll brush 111 and the edge region of the top surface of the substrate W may be increased, and the descending pressure applied to the edge region by the roll brush 111 may also be increased, thus increasing the rotational stiffness of the roll brush 111. In another exemplary embodiment, in the case of reducing the internal pressure of the first air bag 123*a* and the internal pressure of the second air bag 123*b* so as to make the internal pressure of the first air bag 123*a* greater than the internal pressure of the second air bag 123*b*, the tilting arm 116 may be tilted in the counterclockwise direction, and may move vertically upwards at the same time.

As described above, the tilting arm 116 is capable of not only performing a tilting operation, but also vertical movement (adjustment), wherein the tilting operation and the vertical movement may be independently and simultaneously (i.e., at least partially overlapping in time) controlled. According to the tilting operation and/or the vertical movement of the tilting arm 116 depending on a change in the pressure of the air bag 123, the contact pressure applied to the edge region of the substrate W by the roll brush 111 may vary, and the rotational stiffness of the roll brush 111 with respect to the substrate W may vary.

Referring to FIGS. 5 and 8, the controller 430 may control the pneumatic control module 410 such that the internal pressure of the first air bag 123*a* is less than the internal pressure of the second air bag 123*b*. Accordingly, the volume of the first air bag 123*a* may become less than that of the second air bag 123*b*, and the roll brush 111 may be tilted together with the tilting arm 116 such that one end thereof is lower than the other end. That is, in contrast to FIG. 7, the vertical height of the second air bag 123*b* may become greater than that of the first air bag 123*a*, and accordingly, the tilting arm 116 and the roll brush 111 may be tilted in the clockwise direction.

The volume of the first air bag 123*a* may become less than that of the second air bag 123*b* when only the first air bag 123*a* contracts, when only the second air bag 123*b* expands, or when the first air bag 123*a* contracts and the second air bag 123*b* expands. In each case, the first spring 122*a* may contract, and/or the second spring 122*b* may extend.

In some embodiments, the controller 430 may increase the internal pressure of the first air bag 123*a* and the internal pressure of the second air bag 123*b*, such that the internal pressure of the first air bag 123*a* is less than the internal pressure of the second air bag 123*b*, thereby making both the first air bag 123*a* and the second air bag 123*b* expand. In this case, since the volume of the first air bag 123*a* is less than the volume of the second air bag 123*b*, the tilting arm 116 and the roll brush 111 may be tilted in the clockwise direction. At the same time, since both the volume of the first air bag 123*a* and the volume of the second air bag 123*b* increase, the tilting arm 116 and the roll brush 111 may move vertically downwards. Each of the first spring 122*a* and the second spring 122*b* may be extended.

The controller 430 may independently control the internal pressure of the first air bag 123*a* and the internal pressure of the second air bag 123*b* to move the tilting arm 116 and the roll brush 111 vertically. Referring to the illustrated embodiment of FIG. 3, the controller 430 may increase the internal pressure of the first air bag 123*a* and the internal pressure of the second air bag 123*b*, such that the internal pressure of the first air bag 123*a* and the internal pressure of the second air bag 123*b* are the same. Accordingly, the first air bag 123*a* and the second air bag 123*b* may be expanded to the same volume, and the vertical heights thereof may increase to the same level. Accordingly, the tilting arm 116 and the roll brush 111 may move vertically downwards without being tilted. Since this vertical movement is performed more minutely than the vertical movement performed by the upper vertical adjustment unit 130, it may be utilized to precisely control the magnitude of the descending pressure applied to the substrate W by the roll brush 111 and the rotational stiffness of the roll brush 111 with respect to the substrate W.

Figure 9:
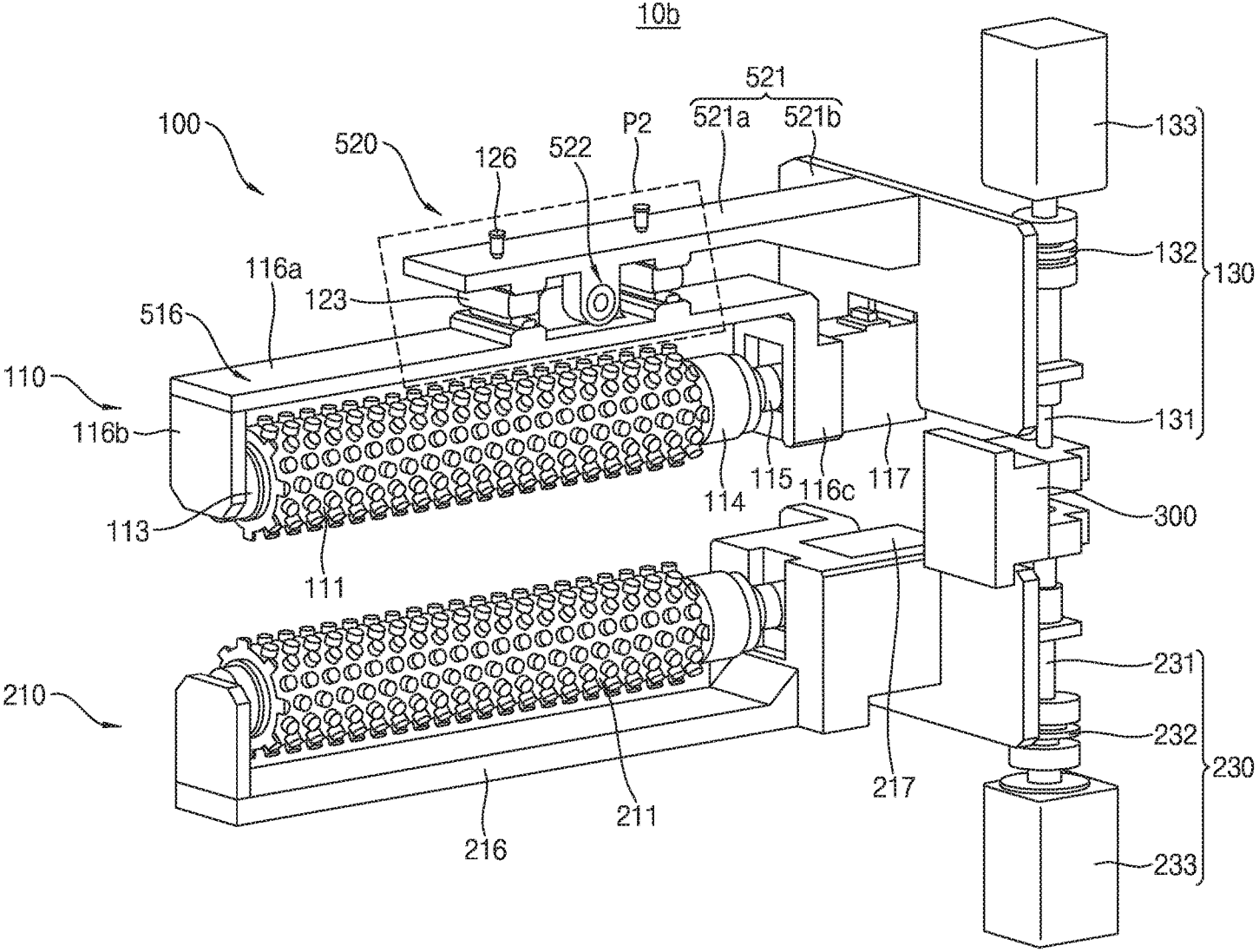
FIG. 9 is a perspective view illustrating a substrate-cleaning apparatus according to embodiments of the inventive concept.
Figure 10:
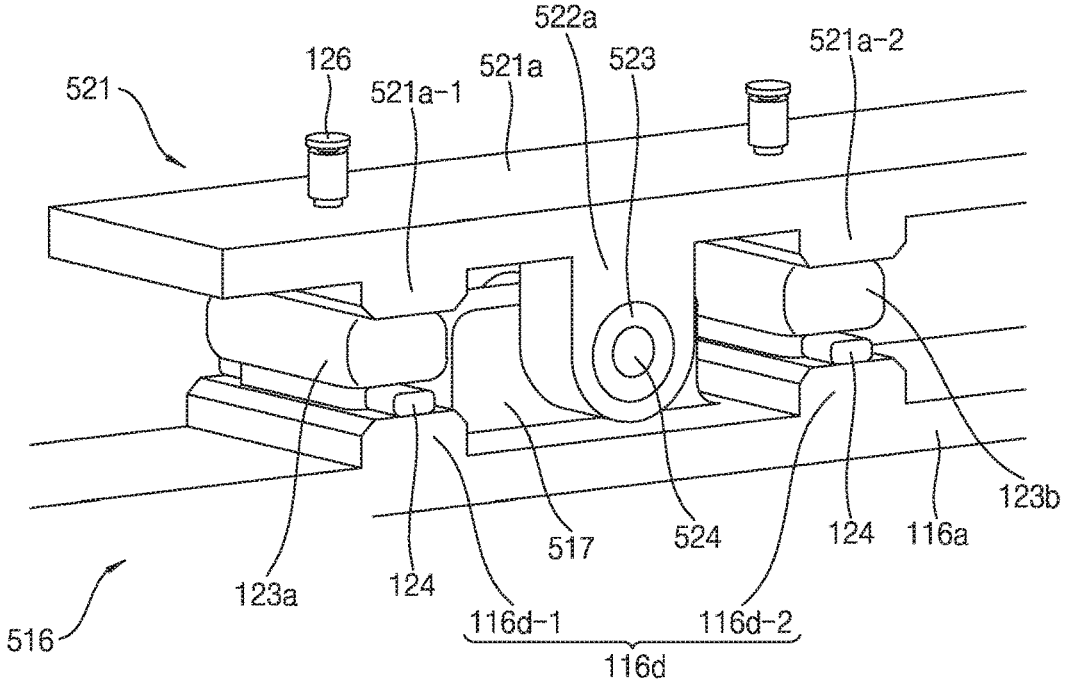
FIG. 10 is an enlarged perspective view of region P2 shown in FIG. 9.
Figure 11:
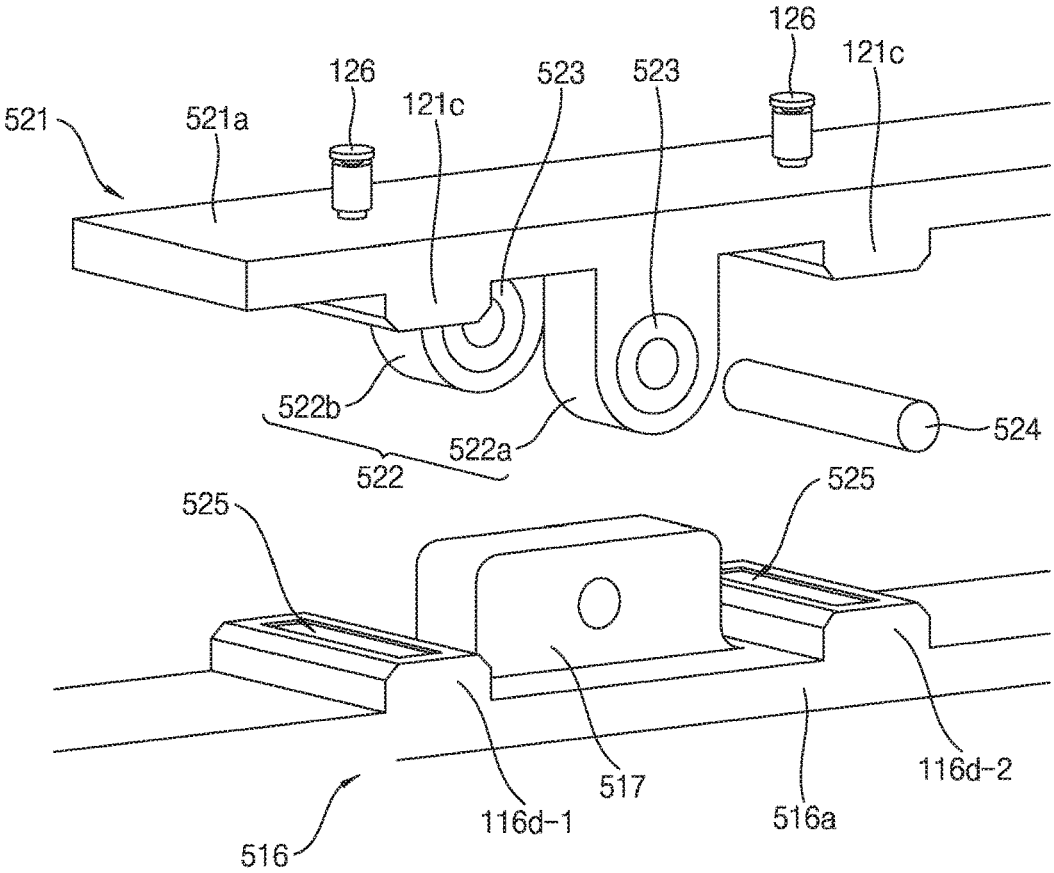
FIG. 11 is an exploded perspective view of the tilting arm and the support arm of FIG. 10.

FIG. 9 is a perspective view of a substrate-cleaning apparatus according to embodiments of the inventive concept; FIG. 10 is an enlarged perspective view of region P2 shown in FIG. 9; and FIG. 11 is an exploded perspective view of the tilting arm and the support arm of FIG. 10.

Referring to FIGS. 9. 10 and 11, an air unit 520 may include an upper bracket 522 protruding from the bottom surface of a body 521*a* of a support arm 521, a bearing 523 secured to the upper bracket 522, and a pivot shaft 524 penetrating the bearing 523. Compared to the air unit 120 described above in relation to the embodiments shown in FIGS. 2 to 8, the air unit 520 may not include a spring. Rather, the upper bracket 522 may be positioned between a first air bag 123*a* and a second air bag 123*b*, wherein the upper bracket 522 includes a first upper bracket 522*a*, as well as a spaced apart, facing second upper bracket 522*b*.

Here, a brush-tilting unit 510 may include a lower bracket 517 protruding from the top surface of a body portion 116*a* of a tilting arm 516. The lower bracket 517 may be disposed between a first lower protruding portion 116*d*-1 and a second lower protruding portion 116*d*-2 of the tilting arm 516. The lower bracket 517 may be inserted between the first upper bracket 522*a* and the second upper bracket 522*b*, and the pivot shaft 524 may be inserted into the first upper bracket 522*a*, the lower bracket 517, and the second upper bracket 522*b*, whereby the upper bracket 522 and the lower bracket 517 may be rotatably coupled to each other. Accordingly, when there is a difference in the internal pressure between the first air bag 123*a* and the second air bag 123*b*, the tilting arm 516 and the roll brush 111 may be tilted about the pivot shaft 524. The substrate-cleaning apparatus 20 of FIG. 9 may perform tilting operation similar to the tilting operation described above in relation to the embodiments shown in FIGS. 7 and 8, except that the tilting operation is performed about the pivot shaft 524. That is, the tilting arm 516, the roll brush 111, and the motor 117 may be tilted in the clockwise direction or the counterclockwise direction about the pivot shaft 524 according to expansion and/or contraction of the first air bag 123*a* and the second air bag 123*b*.

In some embodiments, a groove 525 may be formed in the top surface of the lower protruding portion 116*d* so as to allow the lower portion of the air bag 123 to be inserted thereinto. A groove may also be formed in the bottom surface of the upper protruding portion 121*c* so as to allow the upper portion of the air bag 123 to be inserted thereinto.

As will be apparent to those skilled in the art upon consideration of the foregoing description of exemplary embodiments, the angle at which a roll brush is tilted may be adjusted by controlling the pneumatic pressure of respective air bag(s). Accordingly, the contact pressure between the roll brush and the edge region of a substrate may be increased, and the rotational stiffness of the roll brush may be adjusted. As a result, the efficiency of cleaning of the edge region of a substrate may be improved. In addition, a motor may be coupled to a tilting arm, to which the roll brush is secured, and the tilting arm, the roll brush, and the motor may be integrally tilted. Accordingly, it is possible to prevent an eccentric load, attributable to the tilting, from being applied to the driving shaft of the motor, thereby increasing the lifespan of the motor. In addition, the inclination of the roll brush may be automatically set through a controller, rather than being set through manual operation by a worker. Accordingly, it is possible to more precisely control the contact pressure applied to the substrate and to reduce variation in control between facilities, thereby enabling tool-to-tool matching (TTTM).

While the embodiments of the disclosure have been described with reference to the accompanying drawings, those skilled in the art will understood that various modifications may be made without departing from the scope of the inventive concept. Therefore, the above-described embodiments should be considered as descriptive and exemplary in nature.

What is claimed is:

1. A substrate-cleaning apparatus comprising:

a roll brush coupled to a tilting arm;

a support arm positioned on the tilting arm;

a first spring and a second spring coupling the tilting arm to the support arm;

a first air bag and a second air bag mounted between the tilting arm and the support arm; and a controller configured to adjust a first internal pressure of the first air bag and a second internal pressure of the second air bag, wherein the controller defines an inclination of the roll brush by adjusting a difference between the first internal pressure and the second internal pressure.

2. The substrate-cleaning apparatus of claim 1, wherein the tilting arm comprises a motor-coupling portion secured to a motor, and a driving shaft of the motor penetrates the motor-coupling portion and is connected to the roll brush.

3. The substrate-cleaning apparatus of claim 1, wherein the first air bag is located further away from one end of the roll brush than the second air bag, and the controller adjusts the first internal pressure to be greater than the second internal pressure to tilt the roll brush, such that the one end of the roll brush is higher than another end of the roll brush.

4. The substrate-cleaning apparatus of claim 3, wherein controller adjusts the first internal pressure to expand the first air bag, and adjusts the second internal pressure to contract the second air bag.

5. The substrate-cleaning apparatus of claim 3, wherein controller adjusts the first internal pressure to expand the first air bag, and adjusts the second internal pressure to expand the second air bag less than first air bag.

6. The substrate-cleaning apparatus of claim 1, wherein the first air bag is located further away from one end of the roll brush than the second air bag, and the controller adjusts the first internal pressure to be less than the second internal pressure to tilt the roll brush, such that the one end of the roll brush is lower than another end of the roll brush.

7. The substrate-cleaning apparatus of claim 6, wherein controller adjusts the first internal pressure to contract the first spring, and adjusts the second internal pressure to extend the second spring.

8. The substrate-cleaning apparatus of claim 6, wherein controller adjusts the first internal pressure to expand the first air bag, and adjusts the second internal pressure to expand the second air bag greater than first air bag.

9. The substrate-cleaning apparatus of claim 1, wherein the controller further adjusts at least one of the first internal pressure and the second internal pressure to move the roll brush vertically.

10. The substrate-cleaning apparatus of claim 1, wherein the first air bag and the second air bag are laterally disposed between the first spring and the second spring.

11. The substrate-cleaning apparatus of claim 1, further comprising:

a lower plate laterally penetrating the first air bag and secured to the tilting arm.

12. The substrate-cleaning apparatus of claim 1, further comprising:

an upper plate coupled to the support arm within the first air bag, wherein the upper plate includes a hole allowing gas to pass therethrough.

13. The substrate-cleaning apparatus of claim 1, wherein the tilting arm further comprises:

a first lower protruding portion and a second lower protruding portion protruding from a top surface, and the support arm further comprises:

a first upper protruding portion and a second upper protruding portion protruding from a bottom surface.

14. The substrate-cleaning apparatus of claim 13, wherein the first air bag is disposed between the first lower protruding portion and the first upper protruding portion, and the second air bag is disposed between the second lower protruding portion and the second upper protruding portion.

15. The substrate-cleaning apparatus of claim 1, wherein the support arm comprises therein a through-hole communicating with an interior of the first air bag.

16. The substrate-cleaning apparatus of claim 15, further comprising:

a nozzle connected to the through-hole.

17. A substrate-cleaning apparatus comprising:

a roll brush coupled to a tilting arm, wherein the tilting arm includes a motor-coupling portion securing a motor;

a support arm positioned on the tilting arm;

a first air bag and a second air bag mounted between the tilting arm and the support arm;

an upper bracket positioned between the first air bag and the second air bag and protruding from a bottom surface of the support arm;

a lower bracket protruding from a top surface of the tilting arm;

a pivot shaft inserted into the upper bracket and the lower bracket; and a controller configured to adjust a first internal pressure of the first air bag and a second internal pressure of the second air bag, wherein the controller defines an inclination of the roll brush by adjusting a difference between the first internal pressure and the second internal pressure.

18. The substrate-cleaning apparatus of claim 17, wherein the controller adjust the first internal pressure to be greater than the second internal pressure to tilt the roll brush about the pivot shaft, such that a distal end of the roll brush is higher than a proximate end of the roll brush.

19. The substrate-cleaning apparatus of claim 17, wherein the controller adjusts the first internal pressure to be less than the second internal pressure to tilt the roll brush about the pivot shaft, such that a distal end of the roll brush is lower than a proximate end of the roll brush.

20. A substrate-cleaning apparatus comprising:

a roll brush;

a motor configured to rotate the roll brush;

a tilting arm including a bracket to support the roll brush and a motor-coupling portion to secure the motor, a driving shaft of the motor penetrating the motor-coupling portion to be connected to the roll brush;

a support arm positioned on the tilting arm;

a first air bag and a second air bag suspending the tilting arm from the support arm;

a vertical shaft securing the support arm;

an vertical adjustment driving unit coupled to the vertical shaft to vertically adjust the tilting arm and the support arm;

a regulator connected to the first air bag and the second air bag; and a controller configured to control the regulator to adjust a first internal pressure of the first air bag and a second internal pressure of the second air bag, wherein the controller adjusts a difference between the first internal pressure and the second internal pressure to control an inclination of the tilting arm.

* * * * *